US006523532B1

(12) United States Patent
Esteghlal et al.

(10) Patent No.: US 6,523,532 B1
(45) Date of Patent: Feb. 25, 2003

(54) METHOD FOR OPERATING AN INTERNAL COMBUSTION ENGINE, ESPECIALLY OF A MOTOR VEHICLE

(75) Inventors: Gholamabas Esteghlal, Darmstadt (DE); Georg Mallebrein, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/048,745

(22) PCT Filed: Jun. 16, 2000

(86) PCT No.: PCT/DE00/01996

§ 371 (c)(1),
(2), (4) Date: Jun. 17, 2002

(87) PCT Pub. No.: WO01/09504

PCT Pub. Date: Feb. 8, 2001

(30) Foreign Application Priority Data

Jul. 31, 1999 (DE) ..... 199 36 166

(51) Int. Cl.[7] ..... F02D 41/14
(52) U.S. Cl. ..... 123/698; 123/520
(58) Field of Search ..... 123/698, 520, 123/699, 700, 434, 519

(56) References Cited

U.S. PATENT DOCUMENTS

| | | | | |
|---|---|---|---|---|
| 5,072,712 A | | 12/1991 | Steinbrenner et al. | |
| 5,553,595 A | | 9/1996 | Nishioka et al. | |
| 5,988,151 A | * | 11/1999 | Schneider | 123/520 |
| 6,047,688 A | | 4/2000 | Duty et al. | |
| 6,321,735 B2 | * | 11/2001 | Grieve et al. | 123/520 |

FOREIGN PATENT DOCUMENTS

| | | |
|---|---|---|
| EP | 0 691 469 | 1/1996 |
| EP | 0 810 367 | 12/1997 |
| EP | 1 020 634 | 7/2000 |

* cited by examiner

*Primary Examiner*—Bibhu Mohanty
(74) *Attorney, Agent, or Firm*—Kenyon & Kenyon

(57) ABSTRACT

A method for operating an internal combustion engine, for example, of a motor vehicle, in which a mixture of air and fuel is delivered from a tank by an activated carbon filter and by a tank venting valve to a combustion chamber. The tank venting valve is controlled in an open- and/or closed-loop fashion as a function of a tank gas evolution model and/or an activated carbon filter model.

11 Claims, 3 Drawing Sheets

METHOD FOR OPERATING AN INTERNAL COMBUSTION ENGINE, ESPECIALLY OF A MOTOR VEHICLE

FIELD OF THE INVENTION

The present invention relates to a method for operating an internal combustion engine, for example, of a motor vehicle, in which a mixture of air and fuel is delivered from a tank by an activated carbon filter and by a tank venting valve to a combustion chamber. The present invention also relates to a control device for an internal combustion engine and an internal combustion engine, for example, for a motor vehicle.

BACKGROUND INFORMATION

In vehicles having gasoline-driven engines, a varying quantity of fuel vapor may be present in the fuel tank, depending on fuel temperature, fuel grade, and external pressure. In fuel-injected gasoline engines, the fuel vapor may be collected in an activated carbon filter and then, in tank venting phases provided therefor, mixed by an electrically activatable tank venting valve into the air flow taken into the engine.

The tank venting system, for example, may keep the overall combustion mixture at a desired richness irrespective, to the greatest degree possible, of how saturated the activated carbon filter is with hydrocarbons. For this purpose, the quantity of fuel injected may be correspondingly reduced, when the tank venting valve is open.

Due to a balance of the instantaneous mass gas flow through the tank venting valve, the instantaneous fuel flow required by the engine, the instantaneous lambda value and the mixture correction already performed by the lambda control system, an instantaneous hydrocarbon concentration of the regeneration gas flow (also called the "loading") may be adapted and the quantity of fuel injected may be corrected or controlled, in an open- and/or closed-loop fashion, on the basis of the instantaneous hydrocarbon concentration. The adaptation of the hydrocarbon concentration of the regeneration gas flow should not occur arbitrarily quickly, since the delay time of the distance between the respective injection valve and the lambda probe in the exhaust gas flow may limit the maximum adaptation speed.

During the adaptation process, the instantaneous hydrocarbon concentration of the regeneration gas flow may change until the lambda control system reaches its neutral value $\lambda=1$ or until the mixture deviation becomes zero.

The physical hydrocarbon concentration profile may not be in a steady-state. Concentration spikes may occur, for example, when the activated carbon filtration system does not possess sufficient buffering and the regeneration gas mass flow is changing rapidly, for example, after regeneration off times. Abrupt transient deviations from the stoichiometric air/fuel ratio, that is, from a value $\lambda=1$, may be expected in such a case.

SUMMARY OF THE INVENTION

It is an object of the present invention to provide a method for operating an internal combustion engine that may consider transients that occur upon rapid changes in the regeneration gas mass flow.

This object may be achieved, according to an exemplary embodiment of the present invention, by controlling the tank venting valve in an open- and/or closed-loop fashion, as a function of a tank gas evolution model.

This object may also be achieved, according to another exemplary embodiment of the present invention, by controlling the tank venting valve in an open- and/or closed-loop fashion, as a function of an activated carbon filter model.

The object may also be achieved, according to yet another exemplary embodiment of the present invention, in corresponding fashion, by a control device and an internal combustion engine.

In a control system for considering the instantaneous hydrocarbon concentration in the regeneration gas flow, the system calculating a correction value for correcting the injection quantity, a tank gas evolution model adapting the hydrocarbon gas production in the tank and/or a model of the activated carbon filter is provided, with the aid of the tank gas evolution model and/or the model of the activated carbon filter, to predict the hydrocarbon concentration at the location of the tank venting valve and, on the basis of the prediction, to generate the correction value quickly and reliably, after regeneration off times, so that lambda deviations during dynamic engine operation may be reduced, so that they are not perceptible, even by a sensitive driver.

An exemplary method according to the present invention may be implemented as a control element for a control device of an internal combustion engine, for example, of a motor vehicle. A program that is executable on a computing device, for example, on a microprocessor, and suitable for executing the exemplary method according to the present invention, may be stored on the control element. In this way, therefore, an exemplary embodiment of the present invention may be implemented by a program stored on the control element, so that the control element equipped with the program performs the same way as the exemplary according to the present invention. An electrical storage medium, such as, for example, a read-only memory or a flash memory, may be used, for example, as the control element.

DETAILED DESCRIPTION

An exemplary method according to the present invention provides an open- and/or closed-loop control, for example, for a motor vehicle gasoline engine having direct injection, the exemplary method including a combination of an activated carbon filter model and a tank gas evolution model.

Figure 1:
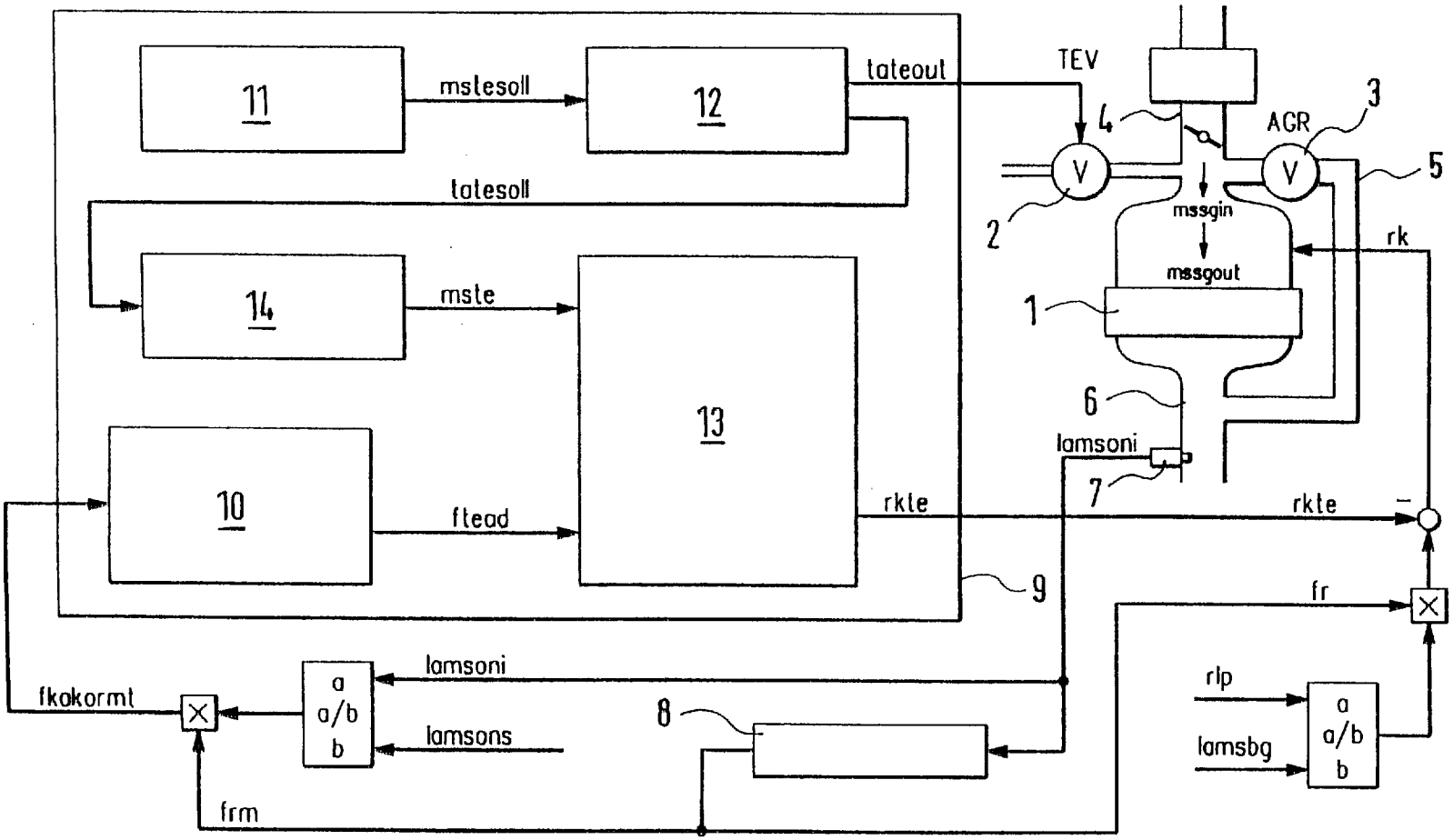
FIG. 1 shows functional blocks representing an overview of a system having tank venting for executing an exemplary method according to the present invention.

In the system overview of FIG. 1, an injection quantity rk, ascertained by an exemplary control method according to the present invention, which is calculated as a function of a pilot control value rlp, a lambda setpoint (lamsbg), an output variable fr of a lambda control system 8 connected to a lambda probe 7 in exhaust pipe 6 of gasoline engine 1, and a correction term rkte of a tank venting system 9, is injected into a gasoline engine 1 through injection valves (not shown). An electrically activatable tank venting valve (TEV) 2, which is acted upon, during the tank venting phases, by a signal tateout, is provided in a pipe leading from a gasoline tank (not shown) through an activated carbon filter (also not shown). The regeneration gas flow through TEV 2 is mixed into the air flow received by gasoline engine 1 in an intake manifold 4, downstream from a throttle valve. An exhaust gas recirculation valve 3 is also provided in an exhaust gas recirculation pipe 5.

In tank venting system 9, block 11 calculates a desired purging flow, which is conveyed as signal mstesoll to block 12, which calculates the pulse duty ratio of the signal tateout for the tank venting phases through tank venting valve 2 and outputs the signal tateout to TEV 2.

The correction term rkte, outputted by tank venting system 9, for correcting or controlling the injected fuel quantity rk, is calculated in functional block 13 from actual mass flow mste of TEV 2 and the instantaneous hydrocarbon concentration or loading ftead of the regeneration gas flow.

The formula for calculating the correction term rkte in functional block 13 is:

$$rkte=mste/(nmot\times KUMSRL)\times ftead,$$

where mste is a TEV actual mass flow;

ftead is a hydrocarbon concentration of the regeneration gas, with a value range from 0 to 30;

nmot is an engine speed; and

KUMSRL is a conversion constant from air mass to relative charge.

Figure 2:
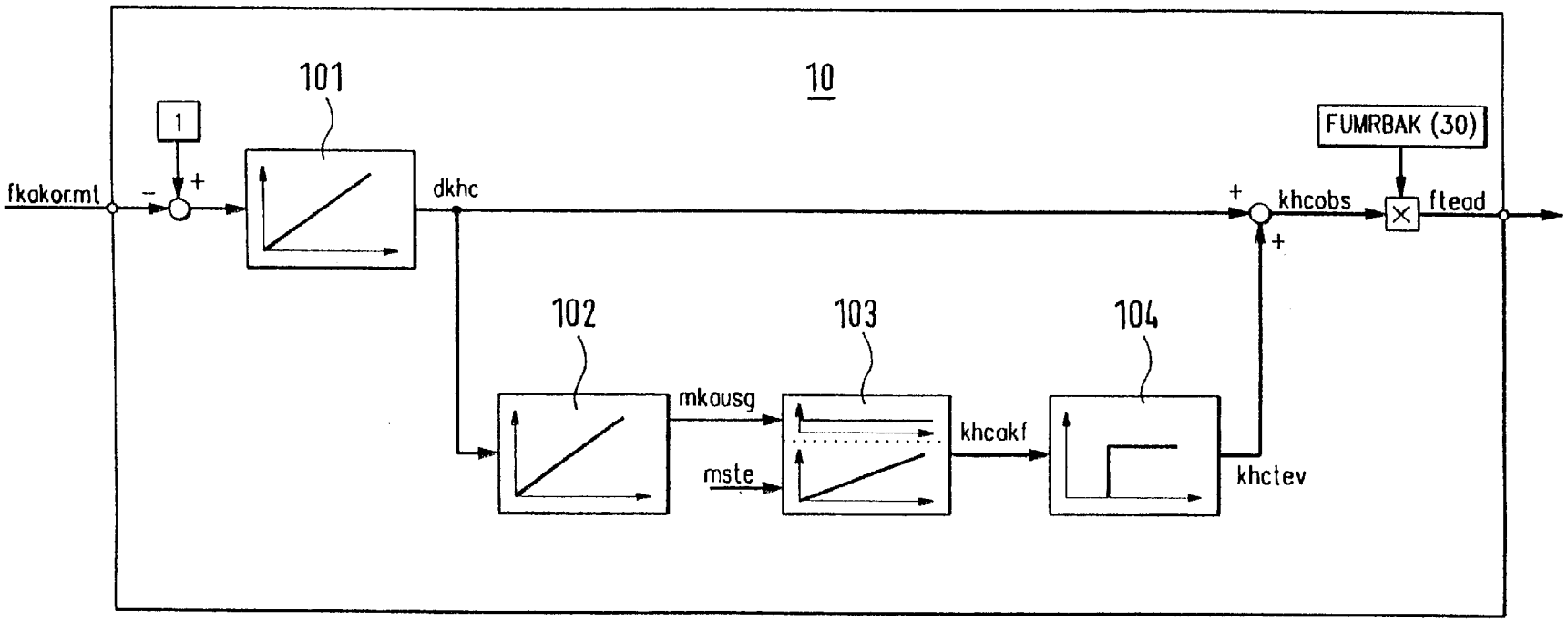
FIG. 2 shows functional blocks of functional block 10 of FIG. 1 representing a tank gas evolution model and a model of an activated carbon filter.

The functions of a tank gas evolution model 102 and of an activated carbon filter model 103, as explained below with reference to FIG. 2, are implemented in functional block 10.

The input variable of functional block 10 is a product (labeled fkakormt) of a lambda control value frm and the relative lambda deviation of an actual lambda value (lamsoni) from a lambda setpoint (lamsons).

FIG. 2 shows details of functional block 10 of FIG. 1, functional block 10 constituting an "observer" of the hydrocarbon concentration of the regeneration gas and including tank gas evolution model 102, which adapts the hydrocarbon gas production in the tank, and activated carbon filter model 103, which reproduces, in model fashion, the behavior of an activated carbon filter.

First, a fast adaptation of a hydrocarbon concentration deviation is performed, based on the input variable fkakormt calculated, as stated above, in functional block 101 constituting an integrator, and a corresponding adaptation value dkhc is outputted.

The branch that includes tank gas evolution model 102, activated carbon filter model 103, and a delay unit 104 generates a predicted value khctev for the hydrocarbon concentration for TEV 2. In this regard, delay unit 104 delays the predicted value khcakf of the activated carbon filter model by an amount equivalent to the gas transport time from the activated carbon filter to tank venting valve 2. The delayed predicted value khctev is combined with the fast adaptation value dkhc of the hydrocarbon concentration, generated in integration block 101, to yield the loading ftead that represents the output value of functional block 10, that is, the hydrocarbon concentration of the regeneration gas.

This may be accomplished as follows:

$$ftead=FUMRBRK\times khcobs,$$

in which $$khcobs=dkhc+khctev$$

where

FUMRBRK (conversion factor)=30;

khctev is the hydrocarbon concentration from activated carbon filter model 103; and dkhc is the required remaining mixture correction.

The output value ftead of functional block 10 is therefore the product of a hydrocarbon concentration in the range 0–1 and a conversion factor FUMRBRK=30. khcobs is calculated from the sum of the fast adaptation value dkhc and the value khctev outputted from delay element 104. Block 10, which predicts the hydrocarbon concentration of the regeneration gas flow at TEV 2, may function, for example, as follows:

An instantaneous deviation between a physical hydrocarbon concentration and a hydrocarbon concentration ftead calculated in the tank venting function results in a mixture correction factor fkakormt≠1.0.

For example, if ftead is too low, fkakormt is then <1.0, since TEV 2 gives too little consideration to the hydrocarbon quantity. dkhc then rises. Due to the integrating function of tank gas evolution model 102 that adapts the gas evolution, the model's output variable mkausg rises when dkhc has a positive value, resulting in the output variable khcakf of activated carbon filter model 103, and then the value khctev delayed by delay element 104, also rising, purging flow being constant. The output variable ftead of functional block 10, which is employed to calculate the injection correction term rkte in functional block 13, rises until the true value of the hydrocarbon concentration is reached.

With an exemplary method according to the present invention the hydrocarbon concentration profile may be predicted. A pilot control system exists for the hydrocarbon concentration. Lambda errors that occur during tank venting may thus be much smaller.

The result of activated carbon filter model 103 is that when, for example, after a long purging off time, the tank venting system once again activates TEV 2, the injection time is, from the outset, reduced much more greatly than in the absence of an activated carbon filter model. If an activated carbon filter model is not installed, a certain lambda deviation may be detectable in such a case.

An exemplary activated carbon filter model according to the present invention, for example, activated carbon filter model 103, is described below with reference to FIG. 3, which represents a volume flow model of the activated carbon filter.

The input variables into activated carbon filter model 103 are:

Mass flow mste aspirated by TEV 2; and

Gas evolution mass flow mkausg.

The output variable is the hydrocarbon concentration khcakf at the output of the activated carbon filter.

Figure 3:
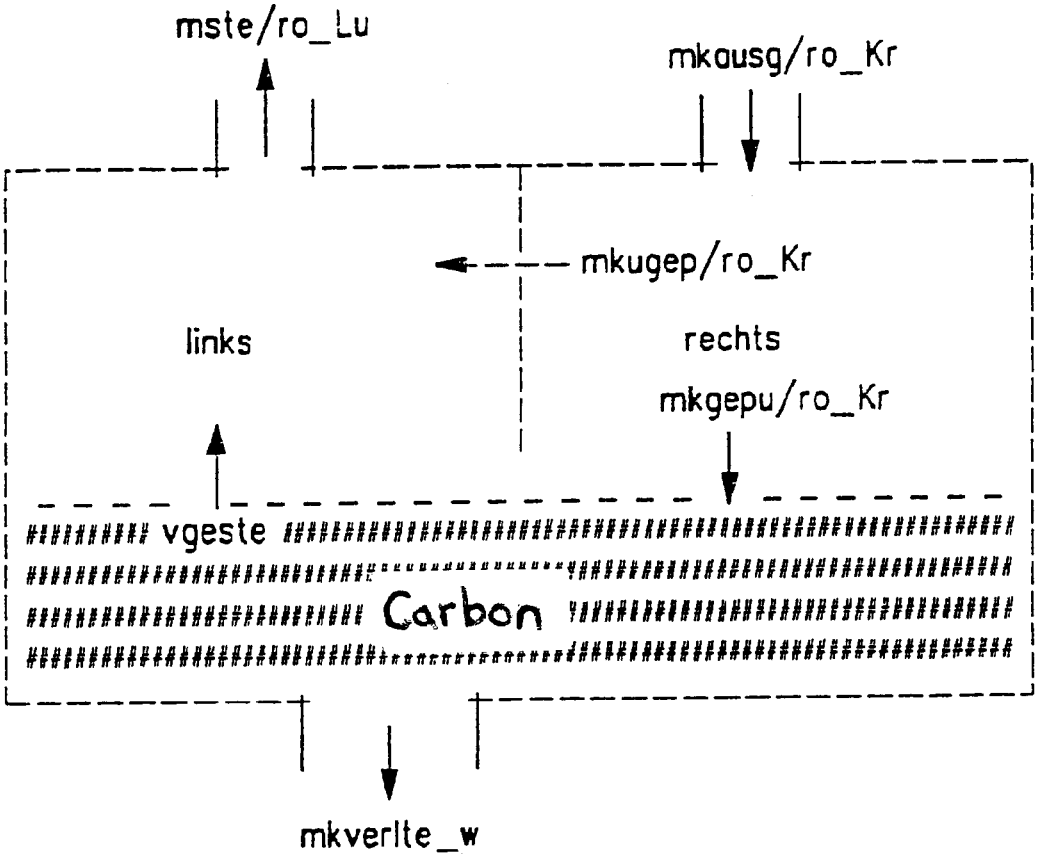
FIG. 3 shows a volume flow model for calculating the activated carbon filter model.

The following are designations and conversions for reference to the volume flow model of the activated carbon filter of FIG. 3:

Volume flow: Fuel vapor flow out of tank:

$$mkausg/(ro_Kr*ftho)$$

Volume flow: Air mass flow into TEV:

$$mste/(ro_Lu*ftho)$$

Volume flow: Unbuffered from right to left (TEV):

$$mkugep/(ro_Kr*ftho)$$

Volume flow: Right chamber into carbon:

$$mkgepu/(ro_Kr*ftho)$$

Volume flow (hydrocarbon+air): Left chamber out of carbon: vgeste ro_Kr:

Standard density of fuel vapor at 0 degrees Celsius and 1013 mbar.

ro_Lu:

Standard density of air at 0 degrees Celsius and 1013 mbar.

ftho:

Temperature and density compensation factor.

Be it assumed that ro_Kr=2*ro_Lu.

The activated carbon filter is divided into a carbon half and an air half. The air half is, in turn, subdivided into a right half (inflow from tank) and a left half (outflow toward TEV).

Volume flow balance for right chamber:

One portion of the fuel vapor flowing out of the tank flows directly toward TEV 2 (mkugep). The other portion (mkgepu) is initially absorbed by the carbon, elevating its hydrocarbon concentration.

Considering that (mkugep/ro_Kr_norm*ftho) should not be greater than (mste/ftho), the volume flow balance of the right side may be as follows:

Calculation: mkugep $$(mkugep/ro_Kr_norm*ftho)=\mathrm{MIN}\ (mste/ftho,\ [mkausg/2*ftho]*[1-fakpuf])$$

Calculation: mkgepu $$(mkgepu/ro_Kr_norm*ftho)=(mkausg/ro_\mathrm{Kr}_norm*ftho)-(mkugep/ro_Kr_norm*ftho)$$

Volume flow balance for left chamber:

$$vgeste=(mste/ro_Lu_norm*ftho)-(mkugep/ro_Kr_norm*fhto)$$

Note: Calculations for mste are made using the density ro_Lu_norm, since mste is referred to air.

Purging mass flow of fuel vapor out of carbon (mksp):

The purging volume flow is made up of air and fuel vapor. Only the fuel vapor flow mksp is of interest, but initially the entire volume flow must be considered:

$$vgeste=vlste+vkste$$

(overall particle flow=air flow+proportional component of fuel vapor flow).

Note: As described below, a distinction is made between a proportional component of the fuel mass flow and a desorption component.

The desorption component may also be negative (KAKFAD has negative values).

$$vlste=(1-khcch)*vgeste$$

(air volume flow as a function of carbon loading).

$$vkste=khcch*vgeste$$

(proportional fuel volume flow as a function of carbon loading).

Desorption equation:

$$mksp=f[vkste+KAKFAD(vgeste)*vlste*khcch]$$

where vkste is the proportional component and KAKFAD is the desorption component.

Fuel balance between carbon and lost fuel:

$$mkcakfh=mkgepu-mksp$$

(HC mass flow taken up by carbon=inflowing mass flow minus outflowing mass flow)

Loss upon overflow of the activated carbon filter:

If the activated carbon filter is full, then mkcakfh=0. The difference is the hydrocarbon loss: mkverlte.

The hydrocarbon concentration profile at the output of the activated carbon filter may be predictable. A pilot control system for the hydrocarbon concentration may thereby be created. Lambda errors that occur during tank venting may be much smaller. In the context of gasoline direct injection, deviations between actual torque and driver-requested torque may be largely eliminated.

The degree of buffering, storage capacity, and desorption readiness of the activated carbon are application parameters, with which the model may be adapted to activated carbon filters.

The effect of the activated carbon filter model utilized in an exemplary control method according to the present invention may be observed at low engine speeds and with a fully loaded activated carbon filter, during tank venting phases, by observing the injection time and pulse duty factor tateout of TEV 2, for example, using an oscilloscope, if the air mass of the engine is first determined and a baseline injection time is calculated. The deviation of the actual injection time from the calculated injection time indicates the tank venting correction using the activated carbon filter model. The mass flow through the tank venting valve may need to be sensed. The loading adapted in the control device is the proportionality factor between the mass flow and the injection reduction. In accordance with an exemplary method of the present invention, the proportionality factor should become smaller with positive load transients.

The aforementioned function of the activated carbon filter by observation of the injection time and pulse duty factor at TEV 2 may be performed, for example, in vehicles having an unbuffered activated carbon filter.

What is claimed is:

1. A method for operating an internal combustion engine of a motor vehicle, in which fuel is delivered through an injection valve to a combustion chamber and a mixture of air and fuel is delivered from a tank to the combustion chamber by an activated carbon filter and a tank venting valve, the method comprising:

ascertaining a first deviation as a function of a lambda deviation of an actual lambda value from a lambda setpoint;

ascertaining a predicted value for a hydrocarbon concentration expected at the location of the tank venting valve from the first deviation as a function of a tank gas evolution model; and controlling a delivery of fuel through the injection valve in at least one of an open-loop configuration and a closed-loop configuration as a function of the predicted value.

2. The method of claim 1, wherein the first deviation is ascertained from a product of a first mixture correction value generated by a lambda control system and the lambda deviation of the actual lambda value from the lambda setpoint.

3. The method of claim 1, wherein the predicted value is first delayed by a delay unit by an amount equivalent to a transport time from the activated carbon filter to the tank venting valve.

4. The method of claim 1, wherein the predicted value is combined with a second deviation ascertained from the first deviation by an integration.

5. The method of claim 4, wherein the tank gas evolution model generates a value for a tank gas evolution that is dependent on the second deviation.

6. The method of claim 5, wherein the value for the tank gas evolution is input into an activated carbon filter model that considers at least one of a storage capacity and a desorption capability of the activated carbon filter.

7. The method of claim 6, wherein the activated carbon filter model ascertains a hydrocarbon concentration at an output of the activated carbon filter based on the value for the tank gas evolution and an instantaneous gas mass flow.

8. A computer program for an internal combustion engine of a motor vehicle, in which fuel is delivered through an injection valve to a combustion chamber and a mixture of air and fuel is delivered from a tank to the combustion chamber by an activated carbon filter and a tank venting valve, comprising:

a computer program including a sequence of instructions for performing the following:

ascertaining a first deviation as a function of a lambda deviation of an actual lambda value from a lambda setpoint;

ascertaining a predicted value for a hydrocarbon concentration expected at the location of the tank venting valve from the first deviation as a function of a tank gas evolution model; and controlling the delivery of fuel through a injection valve in at least one of an open-loop and a closed-loop configuration as a function of the predicted value.

9. The computer program of claim 8, wherein the sequence of instructions are stored on a computer-readable data medium.

10. A control device for an internal combustion engine of a motor vehicle, including an activated carbon filter, a tank venting valve, an injection valve, and a combustion chamber, fuel being deliverable through the injection valve to the combustion chamber and a mixture of air and fuel being deliverable from a tank to the combustion chamber by an activated carbon filter and a tank venting valve, the control device comprising:

a control arrangement to perform the following:

ascertaining a first deviation as a function of a lambda deviation of an actual lambda value from a lambda setpoint;

ascertaining a predicted value for a hydrocarbon concentration expected at the location of the tank venting valve from the first deviation as a function of a tank gas evolution model, and controlling the delivery of fuel through the injection valve in at least one of an open-loop configuration and a closed-loop configuration as a function of the predicted value.

11. An internal combustion engine of a motor vehicle, comprising:

an activated carbon filter;

a tank venting valve;

an injection valve;

a combustion chamber; and a control device operable to ascertain a first deviation as a function of a lambda deviation of an actual lambda value from a lambda setpoint, ascertain a predicted value for a hydrocarbon concentration expected at the location of the tank venting valve from the first deviation as a function of a tank gas evolution model, and control delivery of fuel through the injection valve in at least one of an open-loop configuration and a closed-loop configuration as a function of the predicted value;

wherein fuel is deliverable through the injection valve to the combustion chamber and a mixture of air and fuel is deliverable from a tank to the combustion chamber by an activated carbon filter and a tank venting valve.

* * * * *